United States Patent [19]

Strobl

[11] 3,995,566

[45] Dec. 7, 1976

[54] BULLETPROOF BAFFLE ARRANGEMENT

[76] Inventor: Gustav Lorenz Strobl, Oberbuschweg 225, 5000 Cologne 50, Germany

[22] Filed: Sept. 3, 1975

[21] Appl. No.: 610,015

[30] Foreign Application Priority Data

Sept. 14, 1974 Germany ..... 2444064

[52] U.S. Cl. ..... 109/21.5

[51] Int. Cl.[2] ..... E06B 7/30

[58] Field of Search ..... 109/21.5, 49.5, 10, 109/58.5, 58; 89/36 R

[56] References Cited

UNITED STATES PATENTS

| | | | |
|---|---|---|---|
| 1,736,621 | 11/1929 | Platt | 109/21.5 |
| 2,392,215 | 1/1946 | Abrams et al. | 109/21.5 |
| 3,504,644 | 4/1970 | Schibisch | 109/49.5 |
| 3,749,028 | 7/1973 | Strobl | 109/21.5 |
| 3,901,124 | 8/1975 | Hausenblas | 109/49.5 X |

*Primary Examiner*—Paul R. Gilliam
*Assistant Examiner*—David H. Corbin
*Attorney, Agent, or Firm*—John C. Smith, Jr.

[57] ABSTRACT

A bulletproof baffle member for use in an opening of a bulletproof wall construction comprises a base portion for positioning in the opening and at least one pair of bullet-deflecting baffles extending therefrom at an angle of less than 180°. The confronting surfaces of the baffles include first portions adjacent the base portion which are substantially parallel and second portions extending at an angle from the first portions such that the distance between the surfaces of the second portions increase with increasing distance from the first portions. The configuration of the confronting surfaces of the baffles provide protection against both penetrating shots and ricochets whether the line of fire is oblique to or parallel to the wall construction.

19 Claims, 3 Drawing Figures

FIG. 1
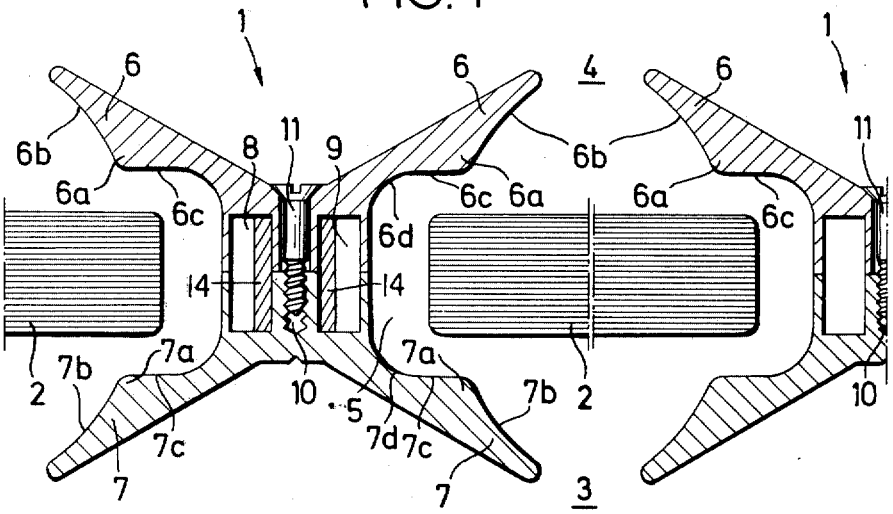
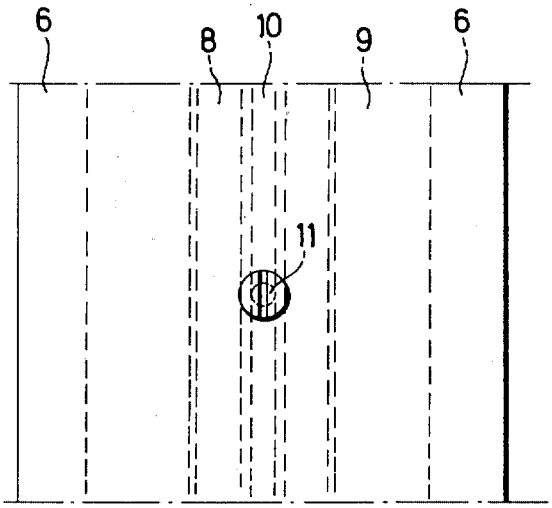
FIG. 2

BULLETPROOF BAFFLE ARRANGEMENT

BACKGROUND OF THE INVENTION

This invention relates to a bulletproof baffle member for positioning in an opening of a bulletproof wall construction to permit communication therethrough while preventing the passage of bullets and to an improved bulletproof arrangement incorporating the device. The device is designed for use at cash desks and ticket offices to protect the cashier or attendant.

The security and safety of a cashier or attendant in an enclosure where a large sum of money is contained has been of major importance. The use of a solid sheet of bulletproof glass is of course essential, but in order to transact business an opening of some nature must be provided. With the provision of the necessary opening the possibility exists of a robbery with the ensuing danger to the life of the cashier or attendant. To improve security against firearms and still provide for communication and transfer of articles, various baffle and opening arrangements have been used. It has been known in the prior art to arrange baffles obliquely to the window in series-fashion. However, such arrangements have not eliminated the possibility of a bullet fired into the baffles ricocheting and endangering the cashier of attendant. This is especially true when the material used in the baffle construction is of sufficient hardness to provide bulletproof characteristics since this increases the tendency for a bullet to ricochet.

Also, projectiles, particularly having a lead core and brass jacket and having a kinetic magnitude of less than 100 mkp, tend to partially disintegrate when striking the baffles producing serrated splinters which may endanger the cashier or attendant. In the case of heavier firearms using larger calibre bullets, there is of course the risk that the bullet will pass through the opening.

OBJECT OF THE INVENTION

The primary object of the present invention is to provide a communication opening or baffle arrangement which provides improved protection against both direct shots and ricochets from all calibres of projectiles.

Another object is to provide a baffle arrangement wherein protection is provided irrespective of whether the line of fire is oblique to or parallel to the wall construction.

A still further object is to provide an arrangement wherein the projectile may be absorbed in the baffle arrangement itself.

SUMMARY OF THE INVENTION

This invention is directed to a device for positioning in an opening of a bulletproof wall construction permitting communication therethrough while preventing the passage of bullets. The device, a bulletproof baffle arrangement, includes a base portion to be positioned in the opening and at least one pair of bullet-deflecting baffles extending therefrom at an angle of less than 180° relative to each other. The confronting surfaces of the pair of baffles include first portions respectively adjacent the base portion which are substantially parallel to each other and second portions respectively extending at an angle from the first portions such that the distance between the surfaces of the second portions increases with increasing distance from the substantially parallel first portions. Thus, when mounted in an opening in a bulletproof wall construction, the base portion is spaced a predetermined distance from at least one side of the opening, the first portions of the pair of baffles are spaced from and are substantially parallel to the respective surfaces of the wall construction and the second portions extend at an oblique angle relative to the respective surfaces of the wall construction forming a speech channel between the side of the opening and adjacent surfaces of the wall construction and the device.

Thus, irrespective of the direction in which the bullet is fired at the communication opening or speech channel, the bullet is deflected in such a way that it strikes the wall construction such as a bulletproof glass wall at a relatively steep angle. Even when the line of fire is nearly parallel to the wall surface, the bullet is deflected more or less in the direction of the wall. At every possible line of fire the bullet meets the resistance of the bulletproof wall and the metal of the baffle, and depending upon the direction of the line of fire, either the bulletproof wall or the baffle becomes effective as a resistance barrier. At least one chamber is provided in the base portion to provide a bullet trap and further prevent ricocheting.

BRIEF DESCRIPTION OF DRAWINGS

Other objects of this invention will appear in the following description and appended claims, reference being made to the accompanying drawing forming a part of the specification wherein like reference characters designate corresponding parts in the several views.

FIG. 1 is a diagrammatic cross-sectional view of baffle members according to the present invention positioned in openings in a bulletproof wall construction;

FIG. 2 is a diagrammatic plan view of the arrangement illustrated in FIG. 1.

DESCRIPTION OF SPECIFIC EMBODIMENTS

Figure 3:
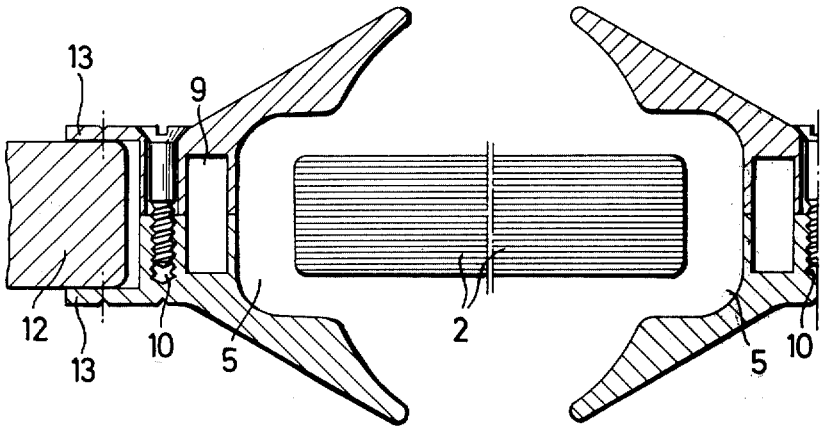
FIG. 3 is a diagrammatic cross-sectional view similar to FIG. 1 of a further embodiment of the invention.

With specific reference to FIG. 1, a bulletproof barrier arrangement is illustrated. The bulletproof baffle device shown generally at 1 is positioned in a speech opening 5 of a wall 2 of bulletproof glass or the like. The wall serves to separate a room 3, accessible to the public, from a cashier's enclosure 4 which is protected against penetration by bullets fired from small firearms. The speech opening 5 is protected by baffles 6 and 7 arranged obliquely relative to the wall 2 so that, as seen in cross-section, an angular speech channel is provided for conducting sound resulting from conversation between persons located on opposite sides of the wall 2. Two baffles 6 and two baffles 7 advantageously form a single unit with a base portion connecting the baffles. Optionally, the base portion may be provided with chambers 8 and 9 defining hollow spaces which serve as bullet traps.

The baffles 6 and 7 are arranged relative to each other at an angle of less than 180°, and the confronting surfaces thereof include first portions **6*c* and 7*c* which are substantially parallel to each other and are spaced from the opposite surfaces of the wall 2 such that the parallel surfaces 6*c* and 7*c* are parallel to the opposite wall surfaces. Second portions 6*b* and 7*b* of the confronting surfaces of the pair of baffles 6 and 7 extend at a angle from the first portions such that the distance between the surfaces of the second portions 6*b* and 7*b*** increase with increasing distance from the substantially parallel first portions. Thus, the surfaces of the second portions 6*b* and 7*b* extend at oblique angles relative to the respective surfaces of the wall 2. Preferably, the surfaces of the second portions 6*b* and 7*b* have a concave configuration as illustrated in FIGS. 1 and 3.

Preferably, the surfaces of the first portions 6*c* and 7*c* merge in an arcuate configuration 6*d* and 7*d* with the surface of the base portion which extends transversely to the surfaces of the wall 2.

The chamber 8 and 9 each defining a hollow space are preferably provided at opposite sides of the base portion; and optionally an additional chamber 10, also defining a hollow space, may be provided between the chambers 8 and 9. The bullet-trapping effect is further implemented when the additional median chamber 10 is also provided. If necessary, a protective flat iron portion 14 or the like may be positioned at least in the two outer chambers 8 and 9.

Conveniently, the bullet-deflecting baffle arrangement may be constructed as two sections which are secured together by screws 11 which project into the median chamber 10 and engage through holes between chamber 10 and the outer surface of the baffle 6. The holes are appropriately larger than the width of chamber 10 so that the screws cooperate with threaded portions at the corresponding points in the chamber 10.

It will be appreciated that the glass wall 2 projects into the space between the baffles 6 and 7 so the speech channel is obtained which has substantially the same width throughout its length. The longitudinally extending projections 6*a* and 7*a* formed between the surfaces of the first portions 6*c* and 7*c* and the second portions 6*b* and 7*b* of the baffles provide protection against penetrating shots and ricochets. Irrespective of whether the line of fire is oblique to or parallel to the wall 2, the projections cause deflection of the bullet directly toward the bulletproof wall 2 or towards the hollow spaces 8, 9 and 10 in the base portion where the bullet is trapped.

In the embodiment shown in FIG. 3, bulletproof baffle arrangements are located in speech openings 5 between opposite ends of bulletproof glass wall 2 and the ends of building wall 12. In this instance, the base portion has only one pair of the bullet-deflecting baffles projecting about opposite sides of the bullet-proof glass wall 2. The opposite side of the base portion includes a pair of spaced parallel flanges or strips 13 for securing the bulletproof baffle arrangement to the building wall 12. The base portion includes only two chambers 9 and 10. The bulletproof baffle arrangement is otherwise substantially the same as that shown in FIG. 1.

The baffles may be formed from any material which exhibits bulletproof characteristics such as metal, hardened glass, or the like. The base portion is also formed from bulletproof material, but this material must, in addition, have the ability of being able to absorb or trap a bullet which is not deflected. Materials which can be used for this purpose include soft metal, plastics, plexiglass, hardwood, etc.

While the bulletproof baffle arrangement has been shown and described in detail, it is obvious that this invention is not to be considered as being limited to the exact form disclosed, and that changes in detail and construction may be made therein within the scope of the invention without departing from the spirit thereof.

I claim:

1. A device for positioning in an opening of a bulletproof wall construction permitting communication therethrough while preventing the passage of bullets therethrough, said device comprising:

a. a base portion for positioning in said opening in the plane of said wall construction and spaced from at least one side of said opening, and b. at least one pair of bullet-deflecting baffles diverging therefrom at an angle of less than 180° relative to each other, c. the confronting surfaces of said pair of baffles having generally convex configurations and including first portions respectively adjacent said base portion which are substantially parallel to each other and second portions respectively extending at an angle from said first portions such that the distance between the surfaces of said second portions increase with increasing distance from said substantially parallel first portions, d. whereby, when a bulletproof glass panel is positioned to extend between and be spaced from said confronting surfaces of said pair of baffles such that one edge of said glass panel is spaced from said base portion and between said substantially parallel first portions of said confronting surfaces of said pair of baffles, a speech channel for communication is provided about said one edge of said glass panel and protection is provided against both penetrating shots and ricochets whether the line of fire is oblique to or parallel to said wall construction.

2. A device according to claim 1 wherein said second portions of said confronting surfaces of said pair of baffles have a concave configuration.

3. A device according to claim 1 wherein said base portion contains at least one hollow chamber.

4. A device according to claim 3 wherein said base portion contains three hollow chambers arranged in series.

5. A device according to claim 3 wherein said hollow chamber contains a protective flat iron.

6. A device according to claim 1 wherein the confronting surfaces of said flat portions of said pair of baffles merge in an arcuate configuration with the surface of said base portion between said baffles.

7. A device according to claim 1 having one pair of said baffles at one side of said base portion and means for securing said base portion to said wall construction at the opposite side thereof.

8. A device according to claim 7 wherein said securing means comprises a pair of parallel flanges for securing to opposite surfaces of said wall construction.

9. A device according to claim 1 wherein said base portion is composed of two segments and includes means for securing said segments together.

10. An improved bulletproof construction adapted to permit viewing and communication therethrough but prevent the firing of bullets therethrough, said construction comprising a. a wall defining the perimeter of an opening therein;

b. at least one bulletproof glass panel mounted in said opening in substantially the same planes as said wall, at least one edge of said glass panel being spaced from the confronting edge of said wall defining said opening;

c. a pair of diverting bullet-deflecting baffles extending, from said confronting edge of said wall defining said opening, beyond said one edge of said glass panel and being spaced respectively from the opposite sides of said glass panel;

d. the confronting surfaces of said baffles each having a generally convex configuration and said one edge of said glass panel being positioned in said plane between said confronting edge of said wall and the apecies of said convex confronting surfaces of said baffles;

e. whereby a speech channel for communication is provided about said one edge of said glass panel and protection is provided against both penetrating shots and ricochets whether the line of fire is oblique to or parallel to said plane.

11. An improved bulletproof wall construction according to claim 10 wherein said confronting surfaces of said baffles each include a first portion extending from said confronting edge of said wall defining said opening, said first portions of said confronting surfaces being spaced from and substantially parallel to the opposite respective surfaces of said glass panel, and a second portion extending from said first portion at an oblique angle relative to the plane of said wall, said one edge of said glass panel being located in said plane between said first portions of said confronting surfaces of said pair of baffles.

12. An improved bulletproof construction according to claim 11 wherein said second portions of said confronting surfaces of said pair of baffles have a concave configuration.

13. An improved bulletproof construction adapted to permit viewing and communication therethrough but prevent the firing of bullets therethrough, said construction comprising a. at least two bulletproof glass panels mounted in spaced relationship in the same plane such that a space is provided between the confronting edges of said glass panels; and b. a device including a base portion positioned in said space and spaced from said confronting edges of said glass panels, said device including two pairs of diverting bullet-deflecting baffles extending from said base portion in opposite directions beyond said respective confronting edges of said glass panels and being spaced respectively from the opposite sides of said glass panels;

c. the confronting surfaces of each pair of baffles each having a generally convex configuration and said confronting edges of said glass panels being positioned respectively in said plane between said base portion and the apecies of said convex confronting surfaces of said baffles;

d. whereby a speech channel for communication is provided about the confronting edge of each of said glass panels and protection is provided against both penetrating shots and ricochets whether the line of fire is oblique to or parallel to said plane.

14. An improved bulletproof construction according to claim 13 wherein said base portion contains at least one hollow chamber.

15. An improved bulletproof construction according to claim 14 wherein said base portion contains three hollow chambers arranged in series.

16. An improved bulletproof construction according to claim 14 wherein said hollow chamber contains a protective flat iron.

17. An improved bulletproof construction according to claim 13 wherein said base portion is composed of two segments and includes means for securing said segments together.

18. An improved bulletproof construction according to claim 13 wherein said confronting surfaces of said baffles each include a first portion extending from said base portion, said first portions of said confronting surfaces being spaced from said substantially parallel to the opposite respective surfaces of said glass panel, and a second portion extending from said first portion at an oblique angle relative to said plane, said edges of said glass panel being located in said plane between said first portions of said confronting surfaces of said respective pairs of baffles.

19. An improved bulletproof construction according to claim 18 wherein the confronting surfaces of said first portions of said pair of baffles merge in an arcuate configuration with the surface of said base portion between said baffles.

* * * * *